US011204226B1

(12) United States Patent
Lee

(10) Patent No.: US 11,204,226 B1
(45) Date of Patent: Dec. 21, 2021

(54) AUTOMATIC CASE FED PRIMING TOOL

(71) Applicant: John D. Lee, Hartford, WI (US)

(72) Inventor: John D. Lee, Hartford, WI (US)

( * ) Notice: Subject to any disclaimer, the term of this patent is extended or adjusted under 35 U.S.C. 154(b) by 0 days.

(21) Appl. No.: 17/037,808

(22) Filed: Sep. 30, 2020

(51) Int. Cl.
*F42B 33/04* (2006.01)
*F42B 33/00* (2006.01)

(52) U.S. Cl.
CPC ..... *F42B 33/04* (2013.01); *F42B 33/001* (2013.01)

(58) Field of Classification Search
CPC ..... F42B 33/04; F42B 33/004
USPC ..... 86/36–38
See application file for complete search history.

(56) References Cited

U.S. PATENT DOCUMENTS 2,794,359 A * 6/1957 Lyman, III ..... F42B 33/04 86/36
3,157,086 A 11/1964 Bachhuber
3,973,465 A * 8/1976 Bachhuber ..... F42B 33/04 86/45
4,223,588 A * 9/1980 Simpson ..... F42B 33/002 86/23
4,331,063 A * 5/1982 Schaenzer ..... F42B 33/004 86/23
4,542,677 A 9/1985 Lee
4,620,472 A * 11/1986 Dillon ..... F42B 33/04 86/25
5,435,223 A * 7/1995 Blodgett ..... F42B 33/04 86/38
5,693,905 A * 12/1997 Blodgett ..... F42B 33/04 86/23
6,260,463 B1 * 7/2001 Brand ..... F42B 33/04 86/24
9,689,651 B1 6/2017 Lee
10,076,781 B1 9/2018 Lee

FOREIGN PATENT DOCUMENTS

EP 3002544 6/2017

* cited by examiner

*Primary Examiner* — Jonathan C Weber
(74) *Attorney, Agent, or Firm* — Donald J. Ersler

(57) ABSTRACT

An automatic case fed priming tool preferably includes a primer insertion device, a primer die body and a primer feed trough. The automatic case fed priming tool is preferably retained in an automatic process press. The automatic process press includes a upper die carrier and a lower die carrier. The primer insertion device preferably includes a breach lock, a moving primer platform, a primer pin and a primer compression spring. The primer die body preferably includes a pin housing, a case push pin, an ejector compression spring, a case finger guide and a case ejector. The primer feed trough preferably includes a first trough half and a second trough half. The primer insertion device is retained in the lower die carrier. The primer die body is retained in the upper die carrier. An exit end of the primer feed trough is attached to the lower die carrier.

20 Claims, 10 Drawing Sheets

AUTOMATIC CASE FED PRIMING TOOL

BACKGROUND OF THE INVENTION

1. Field of the Invention

The present invention relates generally to firearms and more specifically to an automatic case fed priming tool, which does not include a shell holder.

2. Discussion of the Prior Art

U.S. Pat. No. 3,157,086 to Bachhuber discloses a shotgun shell reloader. U.S. Pat. No. 4,542,677 to Lee discloses a cartridge primer feeder. Patent no. EP 3002544 to Gatti discloses a priming machine for cartridges with a metal case. U.S. Pat. No. 9,689,651 to Lee discloses a removable one piece folding primer feeding tray. U.S. Pat. No. 10,076,781 to Lee discloses an automatic processing press.

Accordingly, there is a clearly felt need in the art for an automatic case fed priming tool, which does not include a shell holder; includes a moving primer platform that locates, conveys and sequences a primer escapement mechanism and provides a positive repeatable primer seating depth; and includes an alignment device that centers the case and is compliant for a large range of case sizes.

SUMMARY OF THE INVENTION

The present invention provides an automatic case fed priming tool, which does not include a shell holder. The automatic case fed priming tool (priming tool) preferably includes a primer insertion device, a primer die body and a primer feed trough. The automatic case fed priming tool is preferably retained in an automatic process press, such as the one disclosed in U.S. Pat. No. 10,076,781 to Lee, which is herein incorporated by reference in its entirety. The automatic process press is manufactured by Lee Precision of Hartford, Wis. The automatic process press includes an upper die carrier and a lower die carrier.

The primer insertion device preferably includes a breach lock, a moving primer platform, a primer pin and a primer compression spring. The breach lock includes a knock-out hole, platform counter bore and a rotation flange. The knock-out hole is formed through a length of the breach lock to allow a spent primer to be pushed from a bottom thereof. The platform counter bore is sized to receive an outer perimeter of the moving primer platform. The rotation flange extends from an outer diameter of the breach lock to allow the breach lock to be threaded into a bottom of the lower die carrier. Threads are preferably formed around an outer perimeter of the breach lock on opposing ends of the rotation flange.

The moving primer platform includes a primer hole, a primer spring counter bore, a retention flange, an orientation recess and a primer slot. The retention flange extends outward from a perimeter of the moving primer platform. The primer hole is formed through a length of the moving primer platform. The primer hole is sized to receive the primer pin. The primer spring counter bore is formed through a bottom of the moving primer platform to receive the primer compression spring. The orientation recess extends inward from an edge of the retention flange. An exit end of the primer feed trough is sized to be received by the orientation recess to prevent rotation of the moving primer platform and make a bottom of a lengthwise primer channel coplanar with a bottom of a primer slot. The primer slot is formed in a top of the moving primer platform. A height of the primer slot is slightly greater than a thickness of a primer. The primer pin includes a flange on one end thereof. The primer insertion device is secured in a bottom of a threaded counter bore of the lower die carrier in the following manner. The primer pin is inserted into the primer compression spring. The primer pin with the primer compression spring is inserted into the primer spring counter bore of the moving primer platform. The moving primer platform is inserted into the platform counter bore of the breach lock. The breach lock is threaded into the threaded counter bore of the lower die carrier.

The primer die body preferably includes a pin housing, a case push pin, an ejector compression spring, a case finger guide and a case ejector. The pin housing includes a spring counter bore, an ejector counter bore and threads formed on a bottom thereof. The spring counter bore is formed through substantially all of a length of the pin housing. The ejector counter bore is formed to a depth, which forms an entrance to the spring counter bore. The ejector counter bore is sized to receive an outer perimeter of the case ejector. The case push pin includes a spring diameter, a case diameter and a spring flange. The spring diameter extends from the spring flange. The case diameter extends from the spring diameter. The case finger guide includes a finger rim and a plurality of guide fingers. The plurality of guide fingers extend downward from the finger rim. Each guide finger includes a U-shape. The U-shape allows each guide finger to flex outward to center, but not damage an outer diameter of the case. The case ejector preferably includes an ejector flange, a plurality of finger cavities, a spring counter bore and a pin bore. The ejector flange is formed on a top of the case ejector. The plurality of finger cavities are formed on an outside perimeter of the case ejector, below the ejector flange to receive the plurality of guide fingers. The spring counter bore is formed from the top of the case ejector. The pin bore is formed through a length of the case ejector. The case push pin is inserted into the spring counter bore. The ejection compression spring is slid over the case push pin. The case push pin is inserted into the pin bore of the case ejector. The case ejector is inserted into the case guide. The primer die body is threaded into the upper die carrier.

The primer feed trough preferably includes a first trough half and a second trough half. The first trough half includes a first U-shaped primer channel, a first feed slot, a flexible primer finger and a first fastener yoke. A body of the first trough half preferably includes a non-straight length. The first U-shaped primer channel extends substantially a length of the primer feed trough. The first feed slot is formed at an entrance end of the first trough half to receive a feed channel of a feeding tray, such as the feeding tray disclosed in U.S. Pat. No. 9,689,651 to Lee, which is hereby incorporated by reference in its entirety. The flexible finger is located on an exit end of the first trough half. A free end of the flexible finger contacts a top of a primer and prevents the primer from freely sliding into the primer slot on the moving primer platform. The first fastener yoke extends outward from a side and the exit end of the first trough half. At least two pin assembly holes are formed in an inside surface of the first trough half.

The second trough half includes a second U-shaped primer channel, a second feed slot and a second fastener yoke. A body of the second trough half includes a non-straight length. The second U-shaped primer channel extends substantially a length of the primer feed trough. The second feed slot is formed on an entrance end of the first trough half to receive the feed channel of the feeding tray.

The second fastener yoke extends outward from a side and an exit end of the second trough half. At least two assembly pins extend from an inside surface of the second trough half. The at least two pin assembly holes are sized and located to receive the at least two assembly pins. The first and second U-shaped primer channels form a lengthwise primer channel. The first and second fastener yokes allow the primer feed trough to be attached to a top of the lower die carrier and protrude into the orientation recess of the moveable platform. The first and second feed slots form a feed channel cavity to receive the feed channel of the primer tray.

The priming tool preferably works in the following manner. The primer die body is retained in the upper die carrier. The primer insertion device is retained in the lower die carrier. The primer feed trough is attached to a top of the lower die carrier with two fasteners. A plurality of primers in the feed tray slide down the lengthwise primer channel into the primer slot in the top of the moving primer platform. A case is placed on top of the moveable platform located in the lower die carrier and concentric with the primer pin. An actuation device of the automatic process press is pulled downward. The case ejector will help center the case relative to the case push pin. An inner perimeter of the case, will receive the downward movement of the case push pin. The case guide will center an outer perimeter of the case as the case push pin is inserted into the inner perimeter of the case. The case push pin will force a bottom of the case to compress the spring loaded moving primer platform and the primer pin forces the primer into a primer counter bore in the bottom of the case. Release of the actuation device causes the extractor compression spring to force the case ejector downward and strip the case from the case push pin and the finger guide. As the moving primer platform moves upward, it raises the flexible finger on a first side of the primer feed trough, allowing a new primer to be forced by gravity into an end of the primer slot in the top of the moving primer platform.

Accordingly, it is an object of the present invention to provide an automatic case fed priming tool, which does not include a shell holder.

It is another object of the present to provide an automatic case fed priming tool, which conveys and sequences a primer escapement mechanism and provides a positive repeatable primer seating depth.

Finally, it is another object of the present to provide an automatic case fed priming tool, which includes an alignment device that centers the case and is compliant for a large range of case sizes.

These and additional objects, advantages, features and benefits of the present invention will become apparent from the following specification.

DETAILED DESCRIPTION OF THE PREFERRED EMBODIMENTS

Figure 1:
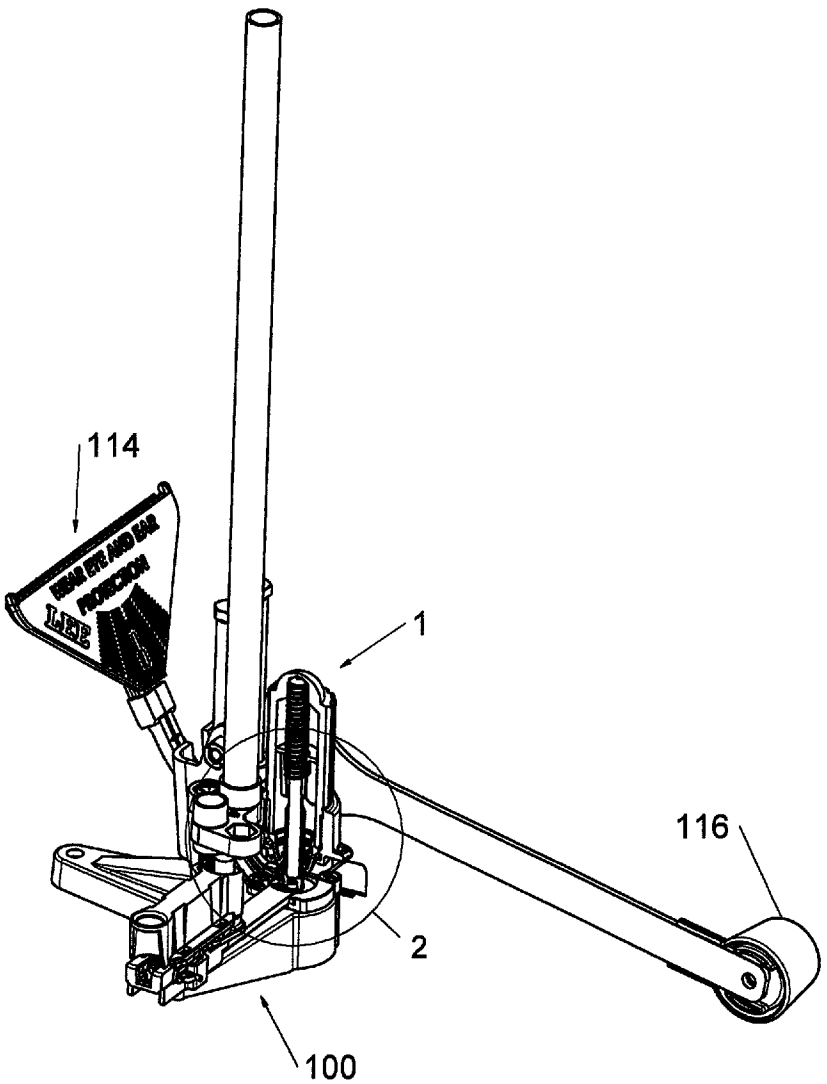
FIG. 1 is a perspective view of a priming tool retained in an automatic processing press and the priming tool fed by a primer feeding tray in accordance with the present invention.

With reference now to the drawings, and particularly to FIG. 1, there is shown a perspective view of a priming tool 1. With reference to FIGS. 3-7, the priming tool 1 preferably includes a primer insertion device 10, a primer die body 12 and a primer feed trough 14. The priming tool 1 is preferably retained in an automatic process press 100, such as the one disclosed in U.S. Pat. No. 10,076,781 to Lee, which is herein incorporated by reference in its entirety. The automatic process press 100 is manufactured by Lee Precision of Hartford, Wis. The automatic process press 100 includes an upper die carrier 102 and a lower die carrier 104.

Figure 3:
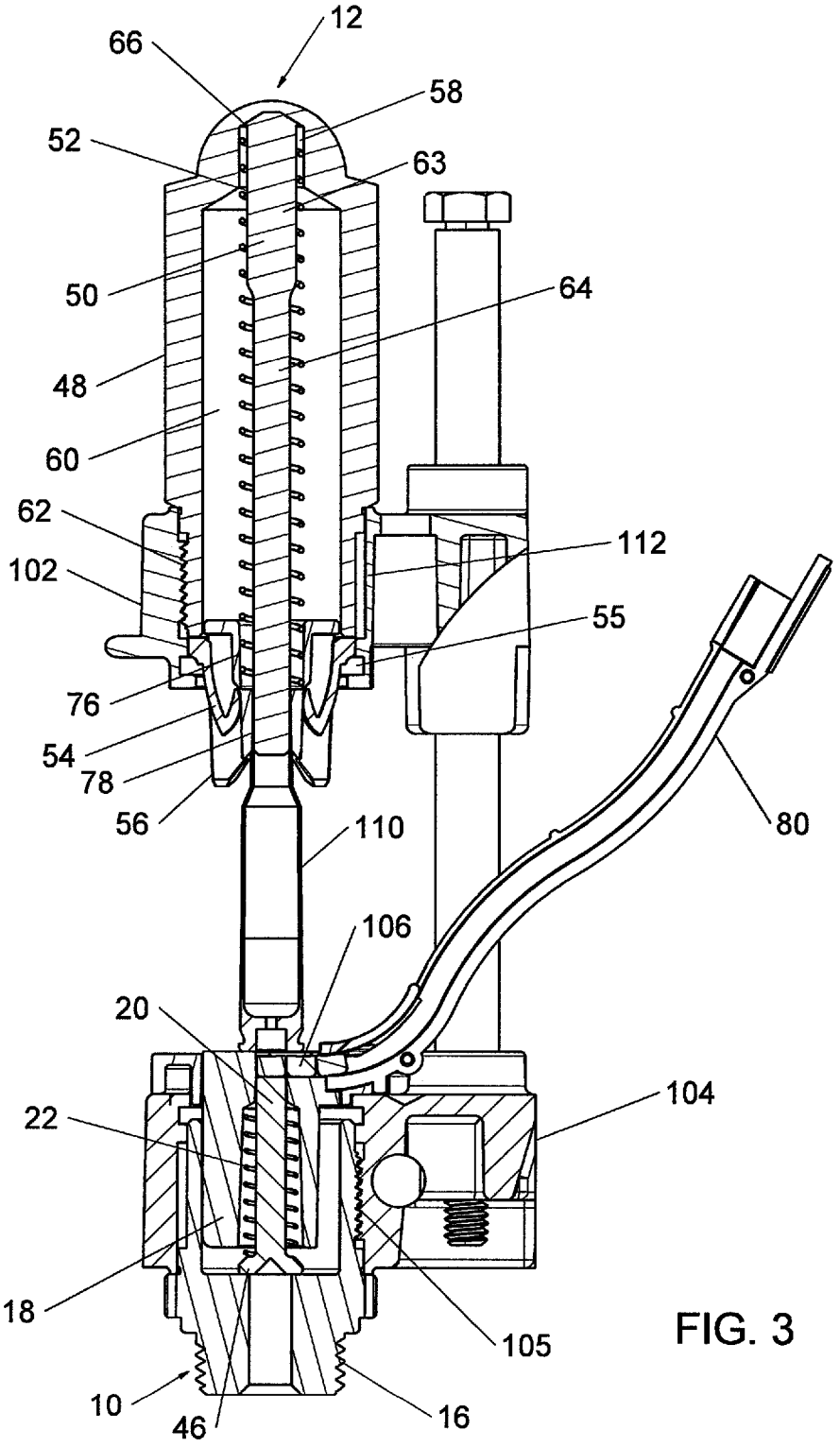
FIG. 3 is a cross-sectional view of a priming tool retained in an automatic processing press and a plurality of primers being fed into a moving primer platform in accordance with the present invention.
Figure 3A:
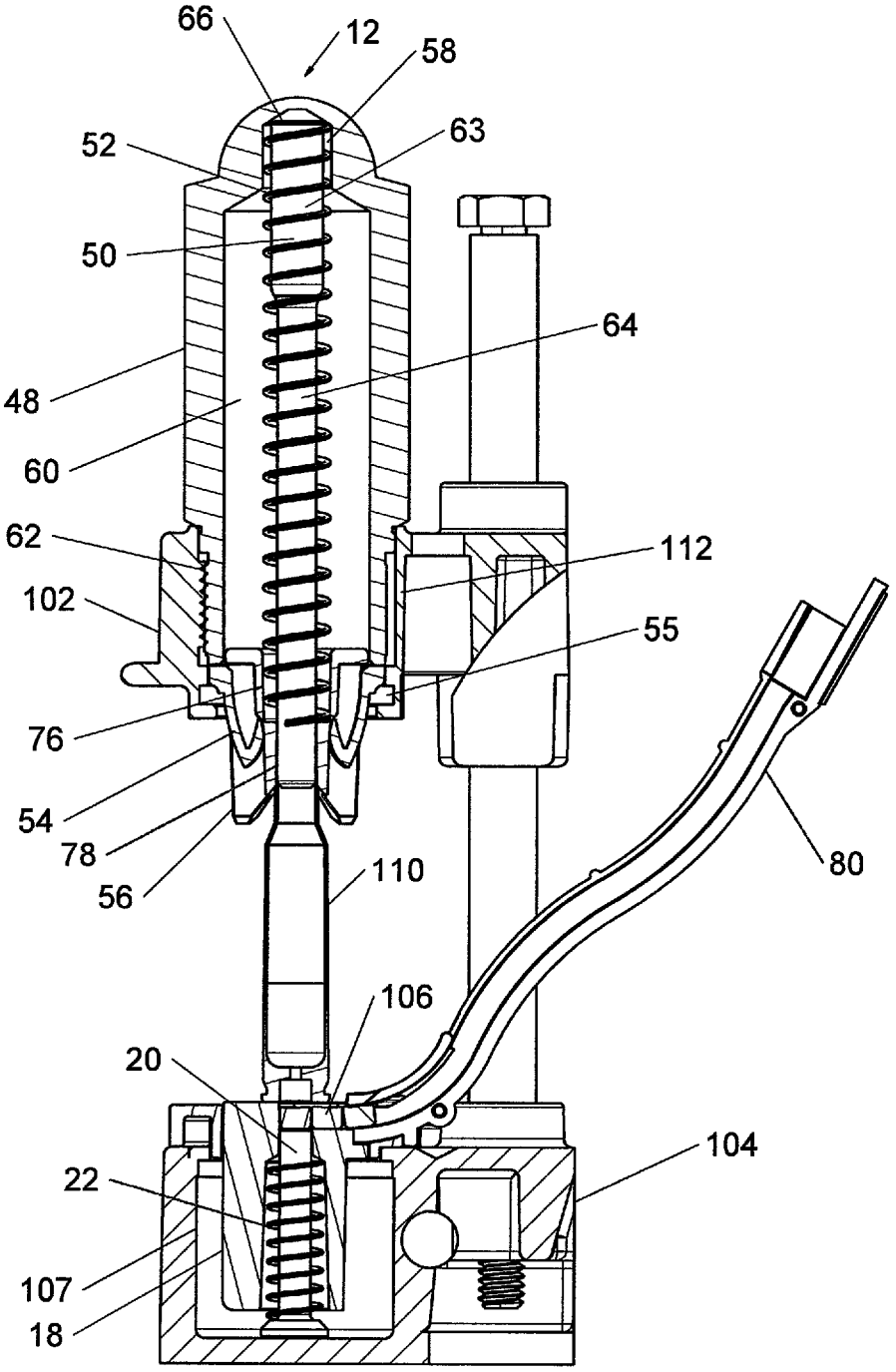
FIG. 3*a* is a cross-sectional view of a priming tool retained in an automatic processing press and a plurality of primers being fed into a moving primer platform with a platform bore replacing a breach lock in accordance with the present invention.
Figure 4:
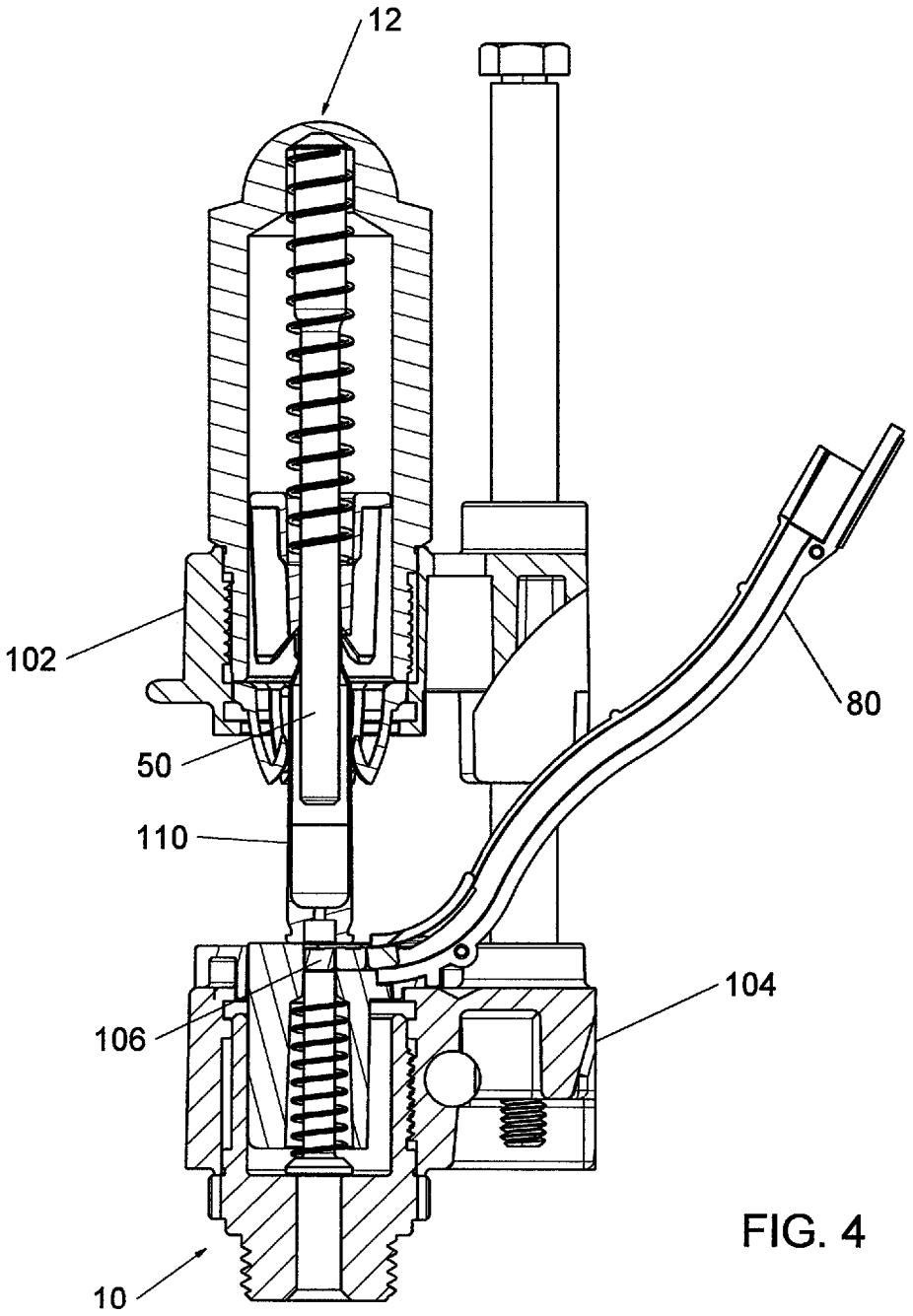
FIG. 4 is a cross-sectional view of a priming tool retained in an automatic processing press and the priming tool in mid-stroke in accordance with the present invention.
Figure 5:
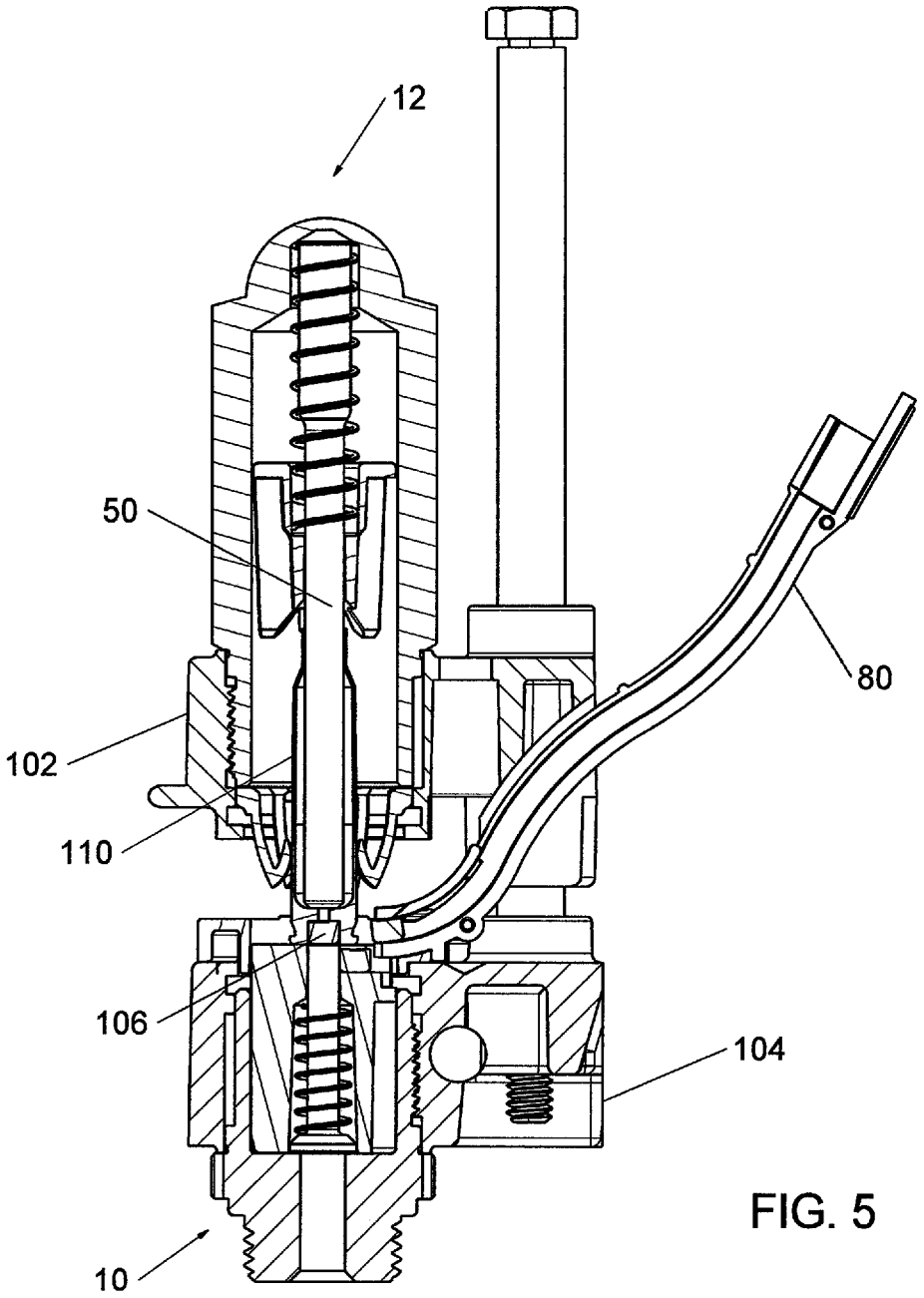
FIG. 5 is a cross-sectional view of a priming tool retained in an automatic processing press and the priming tool seating a primer into a case in accordance with the present invention.
Figure 6:
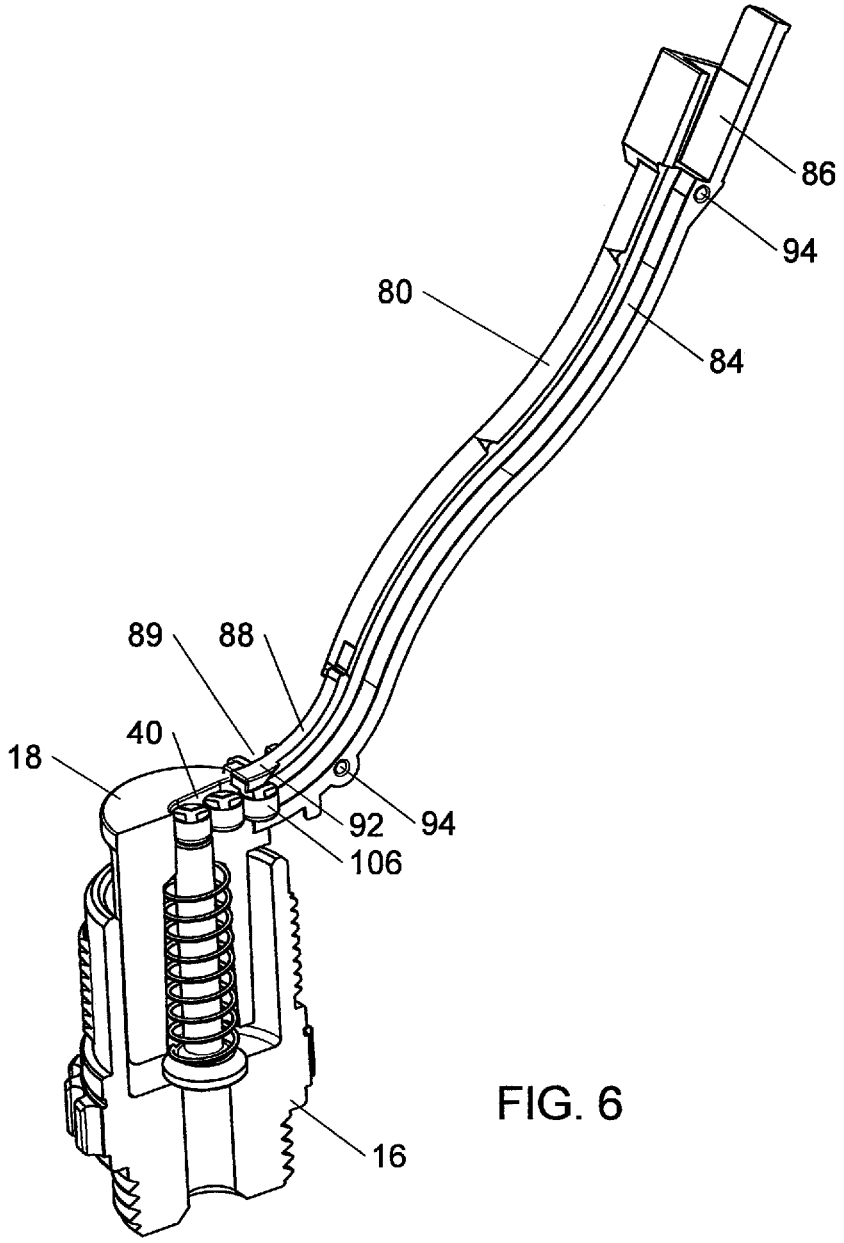
FIG. 6 is a cross-sectional perspective view of a primer insertion device and a first trough half of a priming tool in accordance with the present invention.
Figure 7:
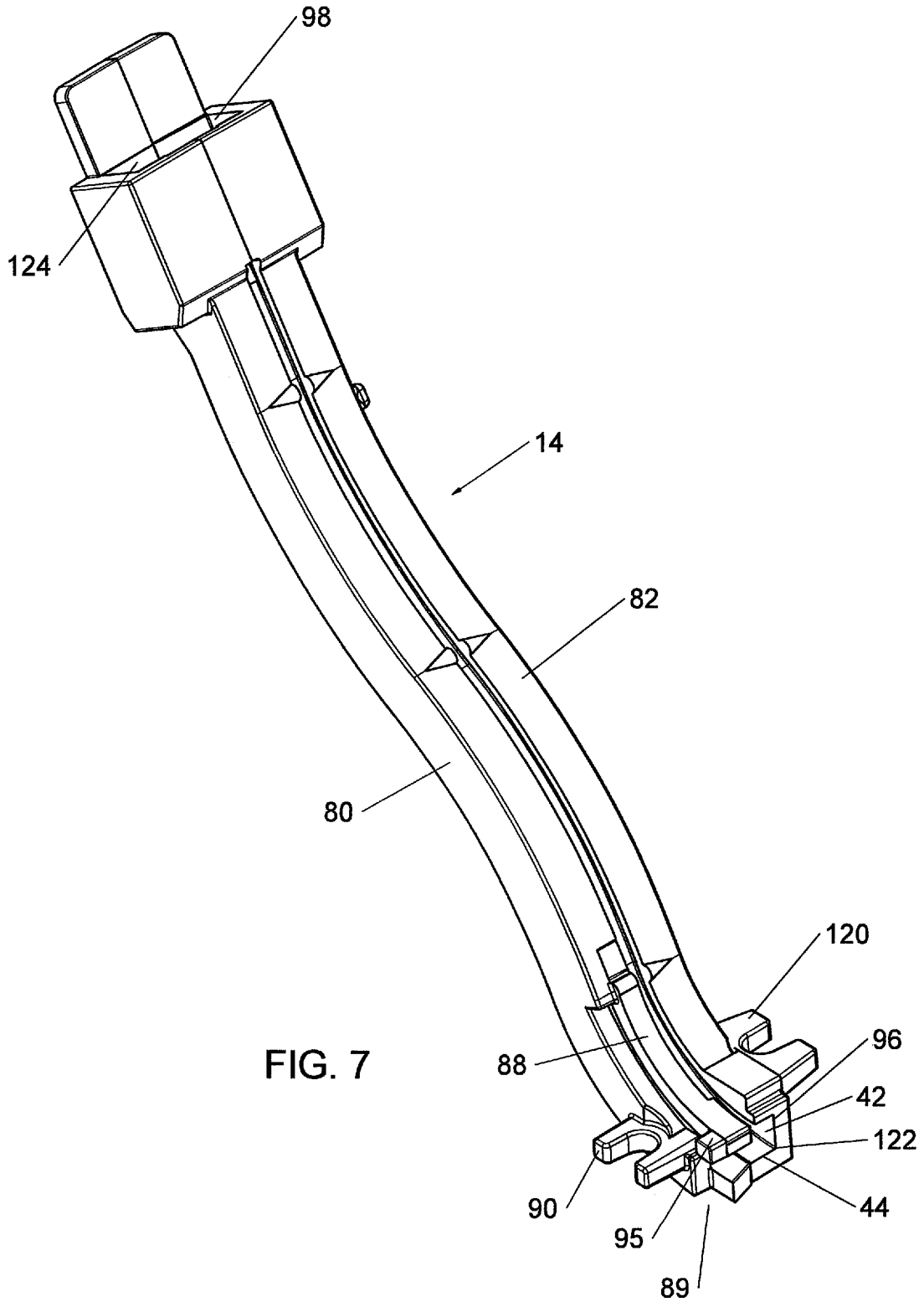
FIG. 7 is a perspective view of a primer feed trough of a priming tool in accordance with the present invention.
Figure 8:
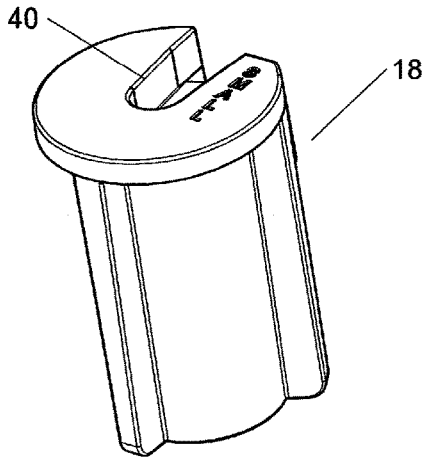
FIG. 8 is a perspective view of a moving primer platform of a priming tool in accordance with the present invention.
Figure 9:
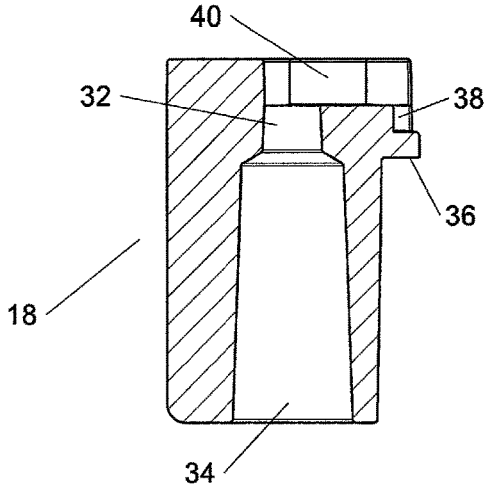
FIG. 9 is a cross sectional view of a moving primer platform of a priming tool in accordance with the present invention.
Figure 10:
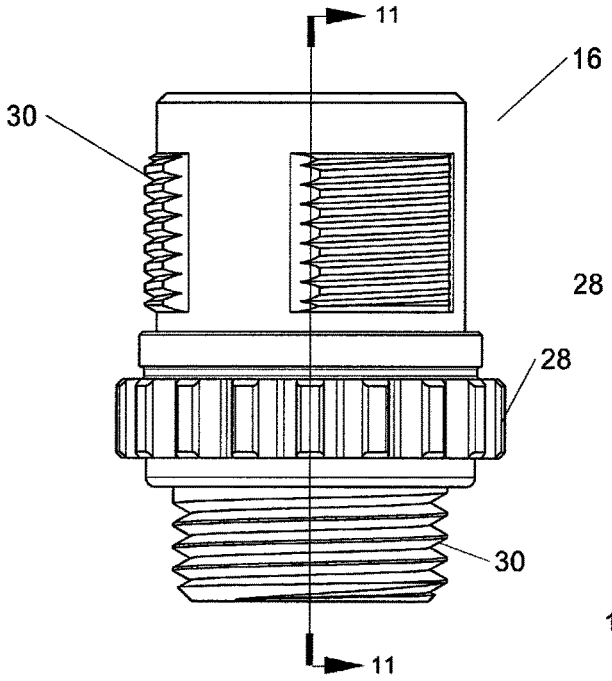
FIG. 10 is a side view of a breach lock of a priming tool in accordance with the present invention.
Figure 11:
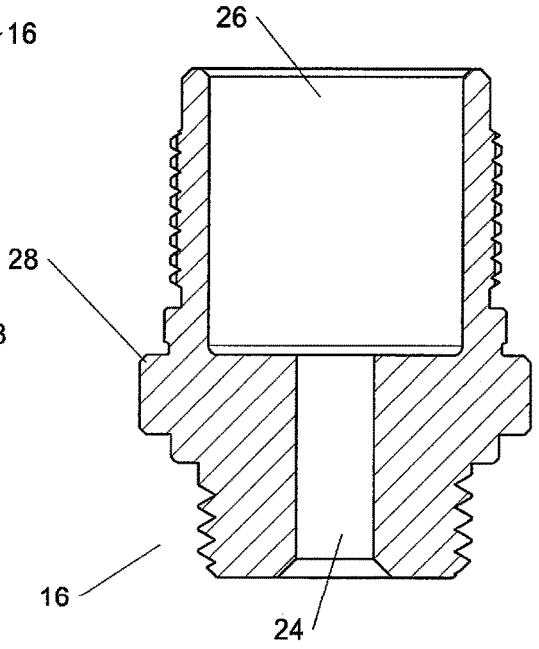
FIG. 11 is a cross sectional view of a breach lock of a priming tool in accordance with the present invention.

With reference to FIGS. 8-11, the primer insertion device 10 preferably includes a breach lock 16, a moving primer platform 18, a primer pin 20 and a primer compression spring 22. The breach lock 16 includes a knock-out hole 24, a platform counter bore 26 and a rotation flange 28. The knock-out hole 24 is formed through a length of the breach lock 16 to allow a spent primer to be pushed from a bottom thereof. The platform counter bore 26 is sized to receive an outer perimeter of the moving primer platform 18. The rotation flange 28 extends from an outer diameter of the breach lock 16 to allow the breach lock 16 to be threaded into a bottom of the lower die carrier 104. Threads 30 are preferably formed around an outer perimeter of the breach lock 16 on opposing ends of the rotation flange 28. With reference to FIG. 3*a*, a platform bore 107 could be formed in a top of the lower die carrier 104 instead a bottom threaded counter bore 105. The platform bore 107 would be sized to receive the moving primer platform 18. The breach lock 16 would be unnecessary, if the platform bore 107 was formed in the lower die carrier 104.

Figure 12:
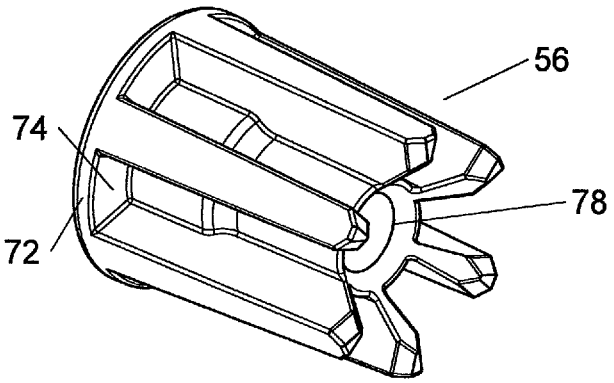
FIG. 12 is a perspective view of a case ejector of a priming tool in accordance with the present invention.
Figure 13:
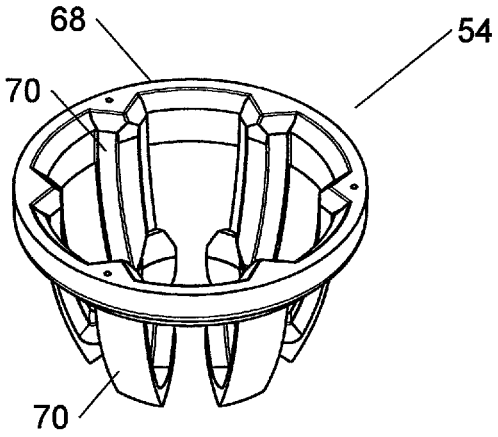
FIG. 13 is a perspective view of a case finger guide of a priming tool in accordance with the present invention.

The moving primer platform 18 includes a primer hole 32, a primer spring counter bore 34, a retention flange 36, an orientation recess 38 and a primer slot 40. The retention flange 36 extends outward from a perimeter of the moving primer platform 18. The primer hole 32 is formed through a length of the moving primer platform 18. The primer hole 32 is sized to receive the primer pin 20. The primer spring counter bore 34 is formed from a bottom of the moving primer platform 18 to receive the primer compression spring 22. The orientation recess 38 extends inward from an edge of the retention flange 36. An exit end 42 of the primer feed trough 14 is sized to be received by the orientation recess 38 to prevent rotation of the moving primer platform 18 and make a bottom of a lengthwise primer channel 44 coplanar with a bottom of the primer slot 40. The primer slot 40 is formed in a top of the moving primer platform 18. A height of the primer slot 40 is slightly greater than a thickness of a primer 106. The primer pin 20 includes a flange 46 on one end thereof. The primer insertion device 10 is secured in the bottom threaded counter bore 105 of the lower die carrier 104 in the following manner. The primer pin 20 is inserted into the primer compression spring 22. The primer pin 20 with the primer compression spring 22 is inserted into the primer spring counter bore 34 of the moving primer platform 18. The moving primer platform 18 is inserted into the platform counter bore 26 of the breach lock 16. The breach lock 16 is threaded into the bottom threaded counter bore 105 of the lower die carrier 104. However, a platform bore could be formed in a top of the lower die carrier 104 to receive With reference to FIGS. 12-13, the primer die body 12 preferably includes a pin housing 48, a case push pin 50, an ejector compression spring 52, a case finger guide 54 and a case ejector 56. The pin housing 48 includes a spring counter bore 58, an ejector counter bore 60 and threads 62 formed on a bottom thereof. The ejector counter bore 60 is formed through substantially all of a length of the pin housing 48. The ejector counter bore 60 is formed to a depth, which forms an entrance to the spring counter bore 58. The ejector counter bore 60 is sized to receive an outer perimeter of the case ejector 56. The case push pin 50 includes a spring diameter 63, a case diameter 64 and a spring flange 66. The spring diameter 63 extends from the spring flange 66. The case diameter 64 extends from the spring diameter 63.

The case finger guide 54 includes a finger rim 68 and a plurality of guide fingers 70. The plurality of guide fingers 70 extend downward from the finger rim 68. Each guide finger 70 includes a U-shape. The U-shape allows each guide finger 70 to flex outward to center, but not damage an outer diameter of a case 110. The case ejector 56 includes an ejector flange 72, a plurality of finger cavities 74, a spring counter bore 76 and a pin bore 78. The ejector flange 72 is formed on a top of the case ejector 56. The plurality of finger cavities 74 are formed in an outside perimeter of the case ejector 56, below the ejector flange 72 to receive the plurality of guide fingers 70. The spring counter bore 76 is formed from the top of the case ejector 56. The pin bore 78 is formed through a length of the case ejector 56. One end of the case push pin 50 is inserted into the spring counter bore 58. The ejector compression spring 52 is slid over the case push pin 50. An opposing end of the case push pin 50 is inserted through the pin bore 78. The case ejector 56 is inserted into the case finger guide 54. The case ejector 56 and the case guide are inserted into a threaded counter bore 112 in the upper die carrier 102. A rubber washer 55 supports the finger rim 68 of the case finger guide 54. The case finger guide 54 axially retains the case ejector 56. The case finger guide 54 prevents the case ejector 56 from being pushed out of the pin housing by the ejector compression spring 52. The primer die body 12 is threaded into the threaded counter bore 112.

The primer feed trough 14 preferably includes a first trough half 80 and a second trough half 82. The first trough half 80 includes a first U-shaped primer channel 84, a first feed slot 86, a flexible primer finger 88 and a first fastener yoke 90. A body of the first trough half 80 preferably includes a non-straight length. The first U-shaped primer channel 84 extends substantially a length of the primer feed trough 14. The first feed slot 86 is formed at an entrance end of the first trough half 80 to receive a feed channel of a feeding tray 114, such as the feeding tray disclosed in U.S. Pat. No. 9,689,651 to Lee, which is hereby incorporated by reference in its entirety. The flexible finger 88 is located on an exit end 89 of the first trough half 80. A free end 92 of the flexible finger 88 contacts a top of the primer 106 and prevents the primer 106 from freely sliding into the primer slot 40 on the moving primer platform 18. The first fastener yoke 90 extends outward from a side and the exit end 89 of the first trough half 80. At least two pin assembly holes 94 are formed in an inside surface of the first trough half 80.

The second trough half 82 includes a second U-shaped primer channel 96, a second feed slot 98 and a second fastener yoke 120. A body of the second trough half 82 includes a non-straight length. The second U-shaped primer channel 96 extends substantially a length of the second trough half 82. The second feed slot 98 is formed on an entrance end of the first trough half 82 to receive the feed channel of the feeding tray 114. The second fastener yoke 120 extends outward from a side and an exit end 122 of the second trough half 82. At least two assembly pins (not shown) extend from an inside surface of the second trough half 82. The at least two pin assembly holes 94 are sized and located to receive the at least two assembly pins. The first and second U-shaped primer channels 84, 98 form the lengthwise primer channel 44. The first and second fastener yokes 90, 120 allow the primer feed trough 14 to be attached to a top of the lower die carrier 104 and protrude into the orientation recess 38 of the moving primer platform 18. The first and second feed slots 84, 98 form a feed channel cavity 124 to receive the feed channel of the primer tray 114.

Figure 2:
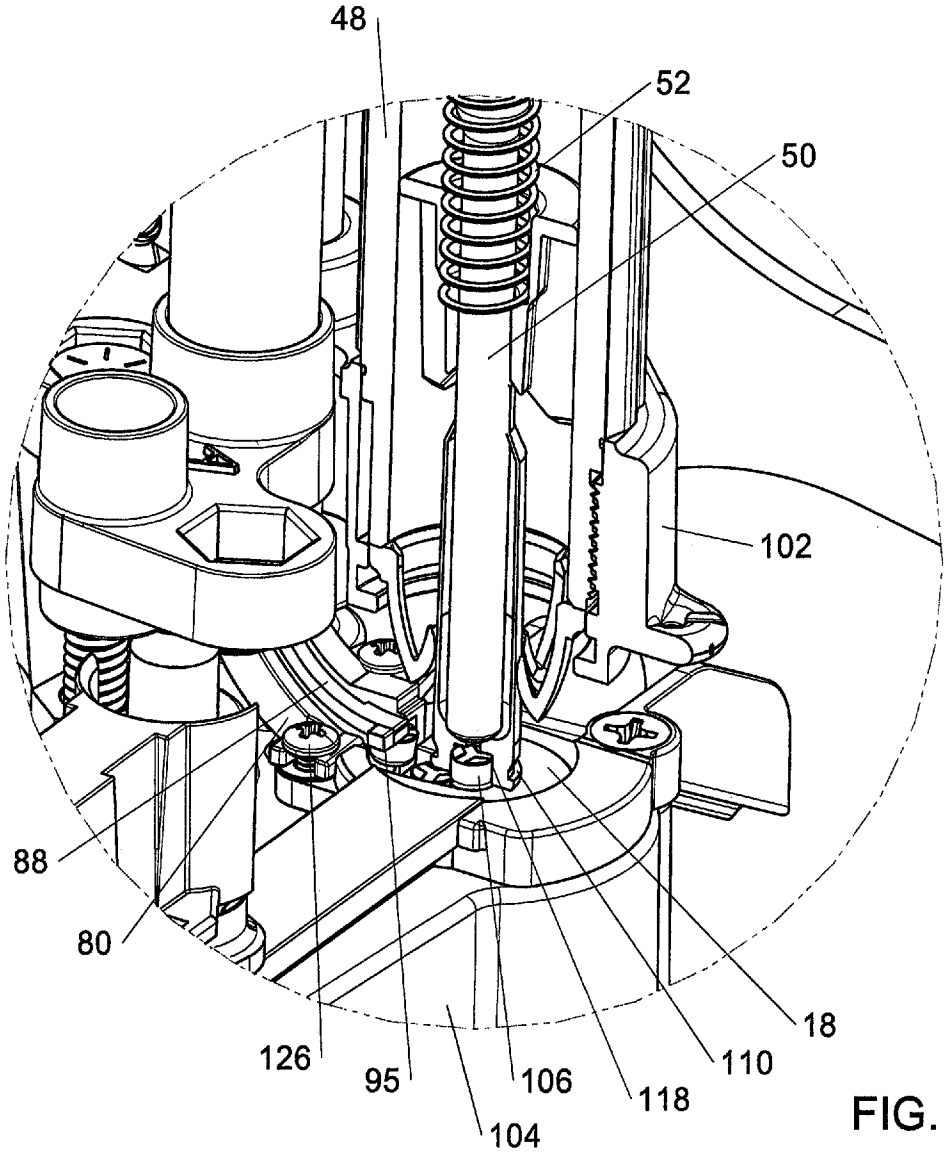
FIG. 2 is a close-up perspective view of a priming tool retained in an automatic processing press in accordance with the present invention.

The priming tool 1 preferably works in the following manner. The primer die body 12 is retained in the upper die carrier 102. The primer insertion device 10 is retained in the lower die carrier 104. With reference to FIG. 2, the primer feed trough 14 is attached to a top of the lower die carrier 104 with two fasteners 126. A plurality of primers 106 in the feed tray 114 slide down the lengthwise primer channel 44 into the primer slot 40 in the top of the moving primer platform 18. The case 110 is placed on top of the moving primer platform 18 located in the lower die carrier 104 and concentric with the primer pin 20. An actuation device 116 of the automatic process press 100 is pulled downward. The case ejector 56 will help center the case 110 relative to the case push pin 50. An inner perimeter of the case 110, will receive the downward movement of the case push pin 50. The case finger guide 54 will center an outer perimeter of the case 110 as the case push pin 50 is inserted into the inner perimeter of the case 110. The case push pin 50 will force a bottom of the case 110 to compress the spring loaded moving primer platform 18 and the primer pin 20 forces the primer 106 into a primer counter bore 118 in the bottom of the case 106. Release of the actuation device 116 causes the ejector compression spring 52 to force the case ejector 56 downward and strip the case 110 from the case push pin 50 and the finger guide 54. As the moving primer platform 18 moves upward, it raises a lift projection 95 on the flexible finger 88 on the first trough half 80, allowing a new primer 106 to be forced by gravity into an end of the primer slot 40 in the top of the moving primer platform 18. The primer feed trough 14 could be eliminated from the priming tool 1 by manually loading primers 106 into the moving primer platform 18 to insert the primers 106 into the cases 110.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A case fed priming tool for use in a processing press, the processing press includes an upper die carrier and a lower die carrier, comprising:

a primer insertion device includes a moving primer platform, and a primer pin, said moving primer platform is retained in a platform bore in the lower die carrier, said moving primer platform is biased outward from the lower die carrier, said primer pin is retained in said moving primer platform; and a primer die body includes a pin housing, a case push pin, a case finger guide and a case ejector, said case push pin extends outward from said pin housing, said case finger guide is sized to receive said case ejector, said case ejector is biased outward from said pin housing, wherein said pin housing is retained in said upper die carrier, an end of said case push pin is sized to be received by an inner diameter of a case, said case push pin forces a primer into a primer counterbore of the case when the processing press is actuated.

2. The case fed priming tool of claim 1 wherein:

said case ejector includes an ejector flange, a plurality of finger cavities and a pin bore, said plurality of finger cavities are formed in a perimeter of said case ejector below said ejector flange, said pin bore is formed through said case ejector to receive said case push pin.

3. The case fed priming tool of claim 2 wherein:

said case finger guide includes a finger rim and a plurality of guide fingers, said plurality of guide fingers extend downward from said finger rim, said plurality of guide fingers are sized to be received by said plurality of finger cavities.

4. The case fed priming tool of claim 1 wherein:

said moving primer platform includes a primer hole, said primer hole is sized to receive said primer pin.

5. The case fed priming tool of claim 1 wherein:

a breach lock is threaded into the lower die carrier to retain said moving primer platform, said breach lock includes a counter bore, said platform counter bore is formed in a top thereof to receive said moving primer platform.

6. An automatic case fed priming tool for use in a processing press, the processing press includes an upper die carrier and a lower die carrier, comprising:

a primer insertion device includes a moving primer platform, and a primer pin, said moving primer platform is retained in a platform bore in the lower die carrier, said moving primer platform is biased outward from the lower die carrier, said primer pin is retained in said moving primer platform; and a primer feed trough includes an entrance end and an exit end, wherein said entrance end is filled with a plurality of primers, said exit end is attached to the lower die carrier; and a primer die body includes a pin housing, a case push pin, a case finger guide and a case ejector, said case push pin extends outward from said pin housing, said case finger guide is sized to receive said case ejector, said case ejector is biased outward from said pin housing, wherein said pin housing is retained in said upper die carrier, an end of said case push pin is sized to be received by an inner diameter of a case, said case push pin forces a primer into a primer counterbore of the case when the processing press is actuated.

7. The automatic case fed priming tool of claim 6 wherein:

said case ejector includes an ejector flange, a plurality of finger cavities and a pin bore, said plurality of finger cavities are formed in a perimeter of said case ejector below said ejector flange, said pin bore is formed through said case ejector to receive said case push pin.

8. The automatic case fed priming tool of claim 7 wherein:

said case finger guide includes a finger rim and a plurality of guide fingers, said plurality of guide fingers extend downward from said finger rim, said plurality of guide fingers are sized to be received by said plurality of finger cavities.

9. The automatic case fed priming tool of claim 6 wherein:

said primer feed trough includes a first trough half and a second trough half, said first trough half includes a first primer channel, a flexible primer finger, said flexible primer finger is located at an exit end of said first tough half, said second trough half includes a second primer channel.

10. The automatic case fed priming tool of claim 9 wherein:

said moving primer platform includes a primer hole, an orientation recess and a primer slot, said primer hole is sized to receive said primer pin, said primer slot communicates with said primer hole, said orientation recess communicates with said primer slot and is located below said primer slot, said orientation recess is sized to receive an exit end of said primer feed trough.

11. The automatic case fed priming tool of claim 9 wherein:

a feed tray includes a primer magazine and a feed channel, said feed channel extends from said primer magazine, an entrance end of said primer feed trough is sized to receive said feed channel.

12. The case fed priming tool of claim 6 wherein:

a breach lock is threaded into the lower die carrier to retain said moving primer platform, said breach lock includes a counter bore, said platform counter bore is formed in a top thereof to receive said moving primer platform.

13. An automatic case fed priming tool for use in a processing press, the processing press includes an upper die carrier and a lower die carrier, comprising:

a primer insertion device includes a moving primer platform, and a primer pin, said moving primer platform is retained in a platform bore in the lower die carrier, said moving primer platform is biased outward from the lower die carrier, said primer pin is retained in said moving primer platform; and a primer feed trough includes an entrance end and an exit end, wherein said entrance end is filled with a plurality of primers, said exit end is attached to the lower die carrier; and a primer die body includes a pin housing, a case push pin, a case finger guide and a case ejector, said case push pin extends outward from said pin housing, said case finger guide is sized to receive said case ejector, said case ejector is biased outward from said pin housing, said case finger guide axially retains said case ejector, wherein said pin housing is retained in said upper die carrier, an end of said case push pin is sized to be received by an inner diameter of a case, said case push pin forces a primer into a primer counterbore of the case when the processing press is actuated.

14. The automatic case fed priming tool of claim 13 wherein:

said case ejector includes an ejector flange, a plurality of finger cavities and a pin bore, said plurality of finger cavities are formed in a perimeter of said case ejector below said ejector flange, said pin bore is formed through said case ejector to receive said case push pin.

15. The automatic case fed priming tool of claim 14 wherein:

said case finger guide includes a finger rim and a plurality of guide fingers, said plurality of guide fingers extend downward from said finger rim, said plurality of guide fingers are sized to be received by said plurality of finger cavities.

16. The automatic case fed priming tool of claim 13 wherein:

said primer feed trough includes a first trough half and a second trough half, said first trough half includes a first primer channel, a flexible primer finger, said flexible primer finger is located at an exit end of said first tough half, said second trough half includes a second primer channel.

17. The automatic case fed priming tool of claim 16 wherein:

said moving primer platform includes a primer hole, an orientation recess and a primer slot, said primer hole is sized to receive said primer pin, said primer slot communicates with said primer hole, said orientation recess communicates with said primer slot and is located below said primer slot, said orientation recess is sized to receive an exit end of said primer feed trough.

18. The automatic case fed priming tool of claim 16 wherein:

a feed tray includes a primer magazine and a feed channel, said feed channel extends from said primer magazine, an entrance end of said primer feed trough is sized to receive said feed channel.

19. The case fed priming tool of claim 13 wherein:

said breach lock includes a platform counter bore and a rotation flange, said platform counter bore is formed in a top thereof to receive said moving primer platform, said rotation flange extends from an outer perimeter of said breach lock.

20. The case fed priming tool of claim 13 wherein:

a breach lock is threaded into the lower die carrier to retain said moving primer platform, said breach lock includes a counter bore, said platform counter bore is formed in a top thereof to receive said moving primer platform.

* * * * *